US005613779A

United States Patent [19]

Niwa

[11] Patent Number: 5,613,779

[45] Date of Patent: Mar. 25, 1997

[54] POUCH

[75] Inventor: Susumu Niwa, Asaka, Japan

[73] Assignee: Kabushiki Kaisha Hosokawa Yoko, Japan

[21] Appl. No.: 351,077

[22] Filed: Nov. 30, 1994

[51] Int. Cl.[6] ..... B65D 30/08

[52] U.S. Cl. ..... 383/201; 383/209; 383/908

[58] Field of Search ..... 383/200, 201, 383/209, 908; 229/87.05; 206/484, 484.1

[56] References Cited

U.S. PATENT DOCUMENTS

| | | | |
|---|---|---|---|
| 3,095,088 | 6/1963 | Blaikie et al. | 383/209 |
| 3,399,760 | 9/1968 | Hechler, IV | 383/207 |
| 3,625,351 | 12/1971 | Eisenberg | 383/200 |
| 3,990,626 | 11/1976 | Goodrich | 383/908 |
| 4,105,116 | 8/1978 | Jones et al. | 206/484 |
| 4,498,591 | 2/1985 | Smith, II | 383/209 |
| 4,598,826 | 7/1986 | Shinbach | 383/200 |
| 4,785,937 | 11/1988 | Tamezawa et al. | 206/484 |
| 4,834,245 | 5/1989 | Ohga et al. | 383/201 |
| 4,903,841 | 2/1990 | Ohsima et al. | 383/200 |
| 5,445,454 | 8/1995 | Barkhorn | 383/207 |

*Primary Examiner*—Stephen P. Garbe
*Attorney, Agent, or Firm*—Parkhurst, Wendel & Burr, L.L.P.

[57] ABSTRACT

A pouch adapted to accommodate medicine or the like comprising first and second compound films forming front and back surfaces of a pouch. Each of these compound films is composed of a resin film having a predetermined tear strength and a resin film having a good heat adhesive property and the first mentioned resin film is provided with a linear slit on one side thereof having un-cut portions. These compound films are overlapped with each other with the resin films having the heat adhesive property being disposed inside so as to oppose each other and with the slits formed to the resin films of the compound films forming the front and back surfaces of the pouch being coincident with each other in positions. The compound films are then heat fused. When a pouch is formed by these compound films, the pouch has an orientation capable of being torn in a direction corresponding to an extending direction of said slit. The orientation of the pouch along which the pouch is liable to be torn is made in consideration of the orientations of the resin films forming the compound films.

11 Claims, 9 Drawing Sheets

POUCH

FIELD OF THE INVENTION

The present invention relates to a pouch having a moisture-proof property adapted to accommodate, for example, medicines, etc.

BACKGROUND OF THE INVENTION

A pouch having a moisture-proof property adapted to accommodate a medicine or the like composed of a compound film material having one layer comprising a resin film with a superior moisture-proof property and gas-barrier property and the other layer comprising a resin film having a good heat adhesive property is known. These layers are laminated with the resin film having the good heat adhesive property being disposed inside when a pouch is formed by utilizing such compound films, and both the layers are thermally bonded or heat fused to each other along the laminated edge portions thereof.

In the pouch of this kind, when a pouch is manufactured by such compound films, since the resin film layer disposed outside having the superior moisture-proof and gas-barrier properties also generally has a heat resisting property and is capable of being easily printed, various advantages may be provided other than the moisture-proof property. On the contrary, a pouch made of such material has a considerably large tear strength, i.e. tear resistance, so that much labour is required to tear the pouch to take out the inner content such as medicine of powder type. For example, it is hard to open the pouch by usual finger force, requiring a scissor or a knife to cut the pouch and take out the inner content.

In order to solve this problem, there has been proposed a pouch in which a slit is formed in one side portion of the outer side resin film of the pouch having a large tear strength to thereby open the pouch using only fingers with a small force.

However, a such pouch having the slit formed in the outside resin film, at the time of manufacturing a compound film by laminating the resin film having the slit on the heat adhesive resin film, may cause the slit to be widely opened when the resin films are laminated, damaging the moisture-proof property. Moreover one end edge of the slit may be overlapped with another end edge forming a staged portion, damaging the opening ability of the pouch. Accordingly, a defective pouch with a poor moisture-proof property may be formed. In an adverse case, it becomes difficult to open the pouch.

Furthermore, in general, the resin film has an orientation along which the resin film is easily torn, and accordingly, even if the slit is formed, an opening line 6, as shown in FIG. 1, is offset from the slit 1 in a direction along which the resin film is easily torn. Therefore, it is difficult to control the tearing direction of the pouch only by the formation of the slit 1. That is, when the pouch is formed, it is necessary to consider the orientation of the resin film to be used.

In order to prevent, those instances where the slit is widely opened and where one end edge of the slit is overlapped with another end edge thereof forming a staged portion, there is proposed a countermeasure, such as disclosed in the Japanese Utility Model Publication No. HEI (JP-Y2-HEI) 4-20759, in which a resin film having a slit 1 and very short un-cut portions 2 (FIG. 2) is laminated on another resin film having a good heat adhesive property. A pouch formed of such a compound film material does not have such a slit defect and provides an improved openable property.

However, in such a pouch, there remains a problem because the opening line is likely to be torn in a manner offset from the slit to a direction along the orientation of the resin film material used for the formation of the compound film, and particularly, even in the above improved manner, this tendency is likely caused at the un-cut portions of the slit, thus also providing a significant problem even in this improved pouch manufacturing method.

SUMMARY OF THE INVENTION

An object of the present invention is to substantially eliminate defects or drawbacks encountered in the prior art and to provide a pouch having an exactly controlled opening direction and an improved moisture-proof property and openability.

This and other objects of the present invention can be achieved by providing a pouch comprising:

a first compound film forming a pouch front surface; and a second compound film forming a pouch back surface, each of the first and second compound films being composed of a first resin film having a predetermined tear strength and provided with a linear slit on one side thereof having un-cut portions formed on the linear slit and a second resin film having a heat adhesive property which is laminated to the first resin film, the first and second compound films being overlapped with each other with the second resin films being disposed inside so as to oppose each other and with the slits formed to the first resin films of the first and second compound films forming the front and back surfaces of the pouch being coincident with each other in positions, and the peripheral portions of the overlapped first and second compound films being heat fused, wherein when a pouch is formed by the first and second compound films, the pouch has an orientation capable of being torn in a direction corresponding to an extending direction of the slit.

In preferred embodiments, each of the first resin films of the first and second compound films has an orientation along which the first resin film is liable to be torn and which corresponds to an extending direction of the slit.

Each of the first and second compound films further includes another resin film having a predetermined tear strength so as to be adjacent to the first resin film. The first and another resin films of each of the first and second compound films have orientations along which the first and another resin films are liable to be torn and which extend in directions balanced with each other with respect to an extending direction of the slit.

The first resin films of the first and second compound films have orientations along which the first resin films are liable to be torn and which extend in directions balanced with each other with respect to an extending direction of the slit when the first and second compound films are laminated to form a pouch.

In further preferred embodiments, each of the first and second compound film may further include an aluminium foil layer which is disposed outside the second resin film when the first and second compound films are laminated to form a pouch. The first resin film may be formed of a biaxially oriented polyethyleneterephthalate film and the second film is formed of a non-oriented polypropylene film.

A notch may be formed in the periphery of each of the first and second compound films at a location continuous to one end portion of the slit. An adhesive layer may be formed between the first and second resin films.

According to the present invention, a pouch is manufactured by using compound films each provided with a resin film having a predetermined tear strength and having a slit with some un-cut portions. Accordingly, the width of the slit can be stably fixed by the location of the un-cut portions formed thereon, so that the slit is not widened and the opposing edge portions of the slits do not overlap when the compound films are laminated, thus maintaining the improved moisture-proof property and openability.

Furthermore, according to the present invention, the direction or orientation of compound films along which the pouch is liable to be torn is made coincident to the extending direction of the slit, so that the opening line does not offset from the slit extending direction at the un-cut portions on the slit, thus the pouch opening direction are effectively controlled in the desired direction.

In more detail, according to one preferred embodiment, since the orientation of the resin film having the large tear strength along which this resin film is liable to be torn is coincident with the slit extending direction, the direction along which the compound films of the pouch are liable to be torn accords with the slit extending direction.

According to another preferred embodiment, since the first resin film and another resin film having large tear strength are laminated so that the orientations of both the resin films are made linearly balanced with respect to the slit extending direction, the composed orientation along which the compound film is liable to be torn accords with the slit extending direction.

According to a further preferred embodiment, since the first resin films provided for the compound films forming the front and back surfaces of the pouch when laminated have their orientations linearly balanced with each other with respect to the slit extending direction, the compound orientation of these compound films accords with the slit extending direction when the pouch is torn.

The nature and further characteristic features of the present invention will be made clearer from the following descriptions in conjunction with the accompanying drawings.

DESCRIPTION OF THE PREFERRED EMBODIMENTS

A first embodiment of the present invention will be described with reference to FIGS. 3A, 3B and 4, in which a pouch 104 is formed of a compound film 103 having a cross section shown in FIG. 3A.

Figure 1:
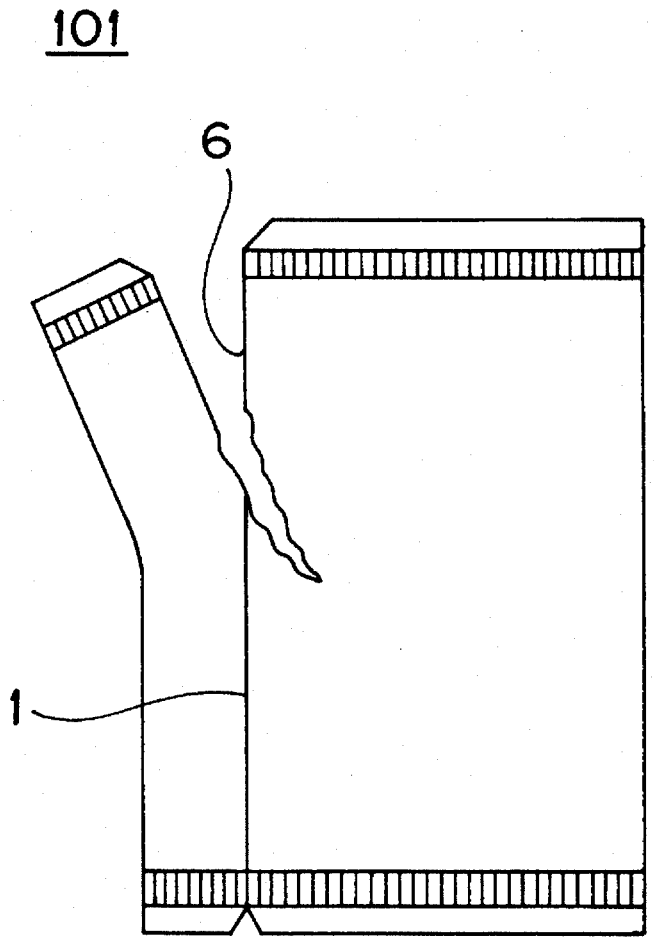
FIG. 1 PRIOR ART
FIG. 1 is a front view of a conventional pouch with a slit which is torn along an undesired opening line when the pouch is opened.
Figure 2:
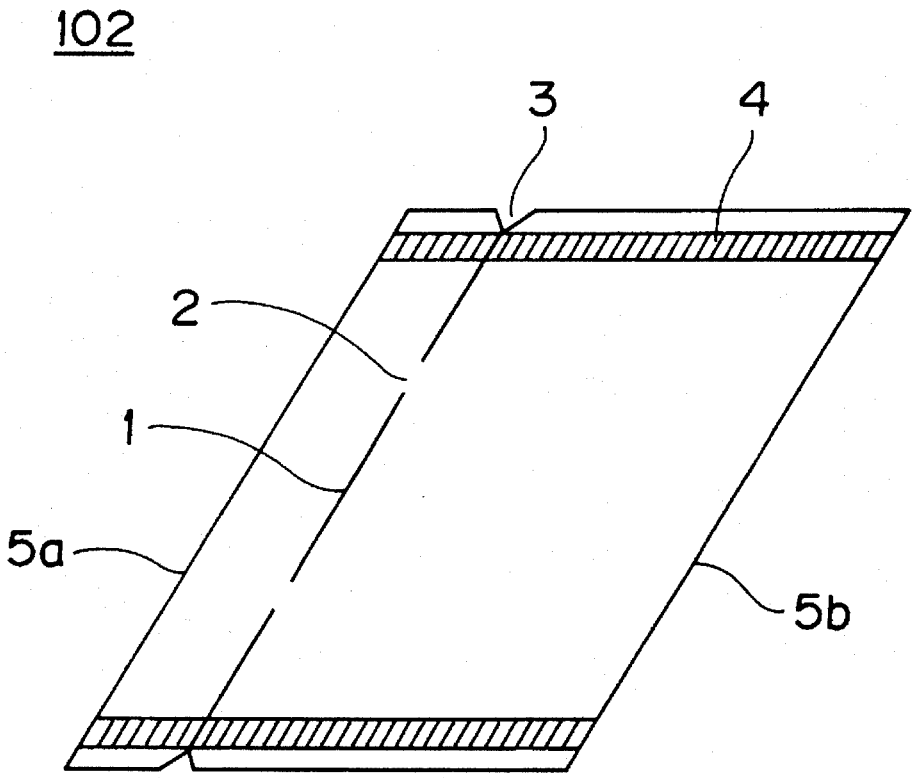
FIG. 2 is a perspective view of a pouch with a slit that has un-cut portions.
Figure 3A:
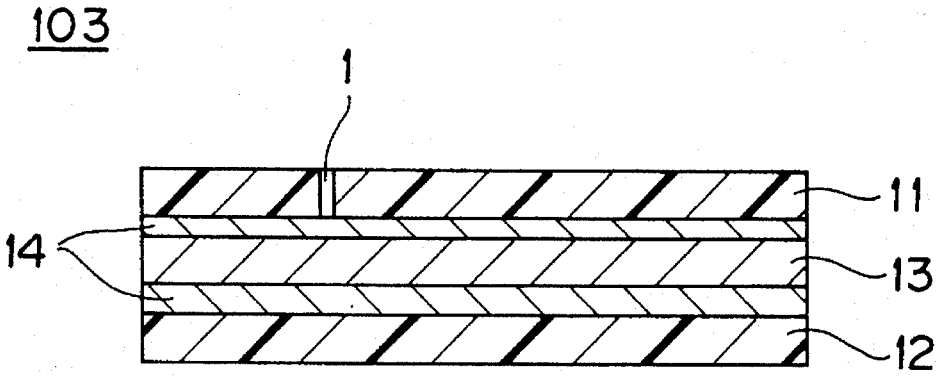
FIG. 3A is a cross sectional view of a compound film from which a pouch according to a first embodiment of the present invention is manufactured.

As shown in FIG. 3A, the compound film 103 is formed by a resin film 11 forming one surface of the compound film 103 and another resin film 12 forming the other surface thereof having an aluminium foil 13 as intermediate layers respectively through adhesive layers 14. However, the intermediate layer 13 and the adhesive layer 14 are optional. The resin film 11 is provided with a slit 1 and has a predetermined tear strength, i.e. tear resistance, and the resin film 12 has a good heat adhesive property. The aluminium foil 13 is utilized for enhancing a moisture-proof property and a light shielding property. In the above embodiment, the adhesive layers may be different from each other.

It is to be noted that the term "predetermined tear strength" or "large tear strength" used herein means a tear strength such that the resin film has a high or strong initial resistance, that is, the resin film can hardly be torn by usual small manual finger force, but when once tearing starts, the resin film will be torn with little resistance, that is, the resin film is torn with relatively small manual finger force.

When a pouch 104 is formed from compound film 103, it is necessary that the most inner layer, i.e. the most inside surface of the pouch, be the heat adhesive resin film 12. However, it is not absolutely necessary that the outside most surface of the pouch be the resin film 11 having the large tear strength and having the slit 1, and it may be possible to locate this resin film 11 between the inner heat adhesive resin film 12 and the aluminium foil layer 13.

As a concrete example of the compound film 103 utilized for the first embodiment of the present invention, the compound film may be formed of a biaxial oriented polyethylene terephthalate film (PET) having a thickness of 12 μm as the resin film 11, an aluminium foil (A1) having a thickness of 9 μm as the intermediate layer 13 and a non-oriented polypropylene film (CPP) having a thickness of 80 μm as the resin film 12.

A uniaxial or biaxial oriented synthetic resin such as biaxial polypropylene or biaxial polyethylene-terephthalate can be utilized as the resin film 11. Referring to FIG. 3B, according to this embodiment, a direction or orientation along which the resin film 11 is liable to be torn is shown by a virtual arrow 21, which accords with the extending direction of the slit 1. When it is required to manufacture pouches continuously by utilizing a long-sized elongated material as the resin film 11 having the large tear strength, it is necessary that the long-size material have an orientation extending in the longitudinal direction thereof along which the material is liable to be torn. For example, as such long-sized material, there may be utilized a film obtained by cutting out a longitudinally central portion of a general biaxial oriented resin film or an oriented film having a strong uniaxial orientation.

Figure 5:
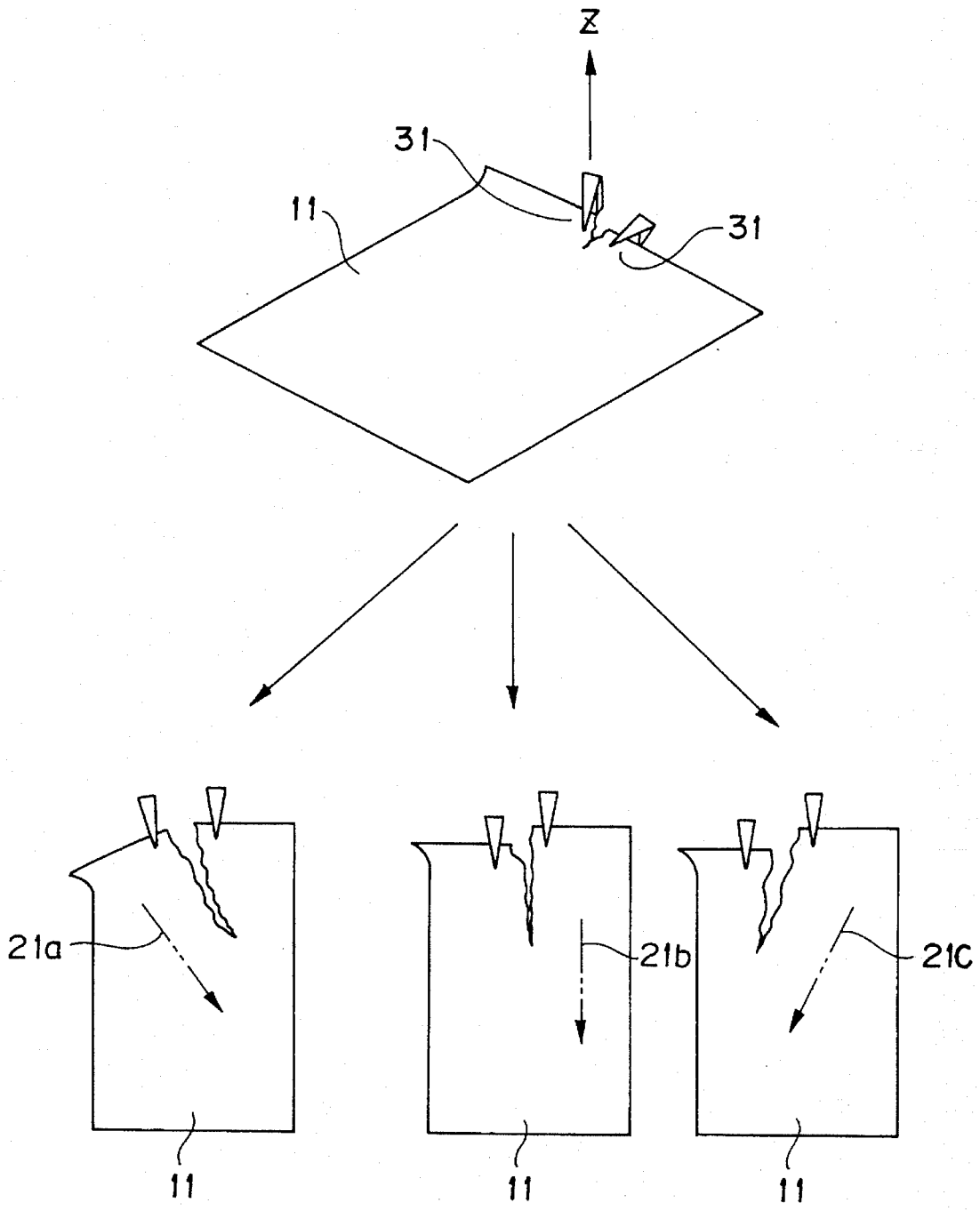
FIG. 5 is an illustration explaining a test performed for examining orientations of resin films having a large tear strength along which the resin films are liable to be torn.

The direction 21 along which the resin film 11 is liable to be torn will be examined in the manner shown in FIG. 5. That is, with reference to FIG. 5, test pieces of the resin film 11 each cut off in the form of a square shape or rectangular shape are fixed in a horizontal direction after determining their front and back side surfaces. The test piece of the resin film 11 is nipped at substantially two central portions of one edge thereof by certain nipping members 31 or fingers, and then, one nipping member 31 is forcibly pulled up in a perpendicular direction z, i.e. upward direction as viewed in FIG. 5 with the other one nipping member 31 being fixed. One nipping member 31 may be of course pulled down in the perpendicular direction z. The direction along which the nipping member 31 is pulled up or down will be determined in consideration of the front or back surface being faced upward or downward.

In such test, the test pieces of the resin film 11 are of course torn along one of the directions 21*a*, 21*b* and 21*c*.

As the resin film 12 having a good heat adhesive property, there can be used a non-oriented polyethylene film or non-oriented polypropylene film.

As the intermediate film 13 such as aluminium foil which can be optionally laminated, it is desired to utilize a material having a small tear strength and a property being liable to be torn together with the resin film 11 along the direction along which the latter is torn.

Further, it is desired to form the slit 1 providing a fine line with un-cut portions 2, which are hardly visible, preferably, to the resin film 11 before the preparation of the compound film 103. Furthermore, it is desired in general to form the slit 1 so as to have un-cut portions 2 separated by a distance of about 100 to 200 mm and each having a length of about 0.1 to 0.5 mm. Although it is desired for the un-cut portion 2 to have a possibly short length for the accurate opening of the pouch, in actuality it is necessary for the un-cut portion 2 to have a length or strength to an extent such that the un-cut portion 2 is not torn by a tension applied to the resin film 11 for smoothing it out to eliminate wrinkles at the time of laminating it to another film.

The compound film 103 is manufactured in the following manner.

A long-sized or sheet-like resin film 11 having large tear strength is fed to a cutting device, provided with a rotary cutter having a diameter of about 5 cm and having no blade portions separated at every 180°, for example, therebetween in the circumferential direction of the rotary cutter, or a vertically movable cutter, to form a slit 1 having un-cut portions 2. The thus formed resin film 11 provided with the slit 1 is then laminated to a resin film 12 having a good heat adhesive property or to another film such as aluminium foil 13. During the lamination, the un-cut portions serve to prevent the slit 1 from being widened in its width direction or from being overlapped at its both opposing end edges. More than one slit 1 may be formed in one sheet of the resin film 11.

Figure 4:
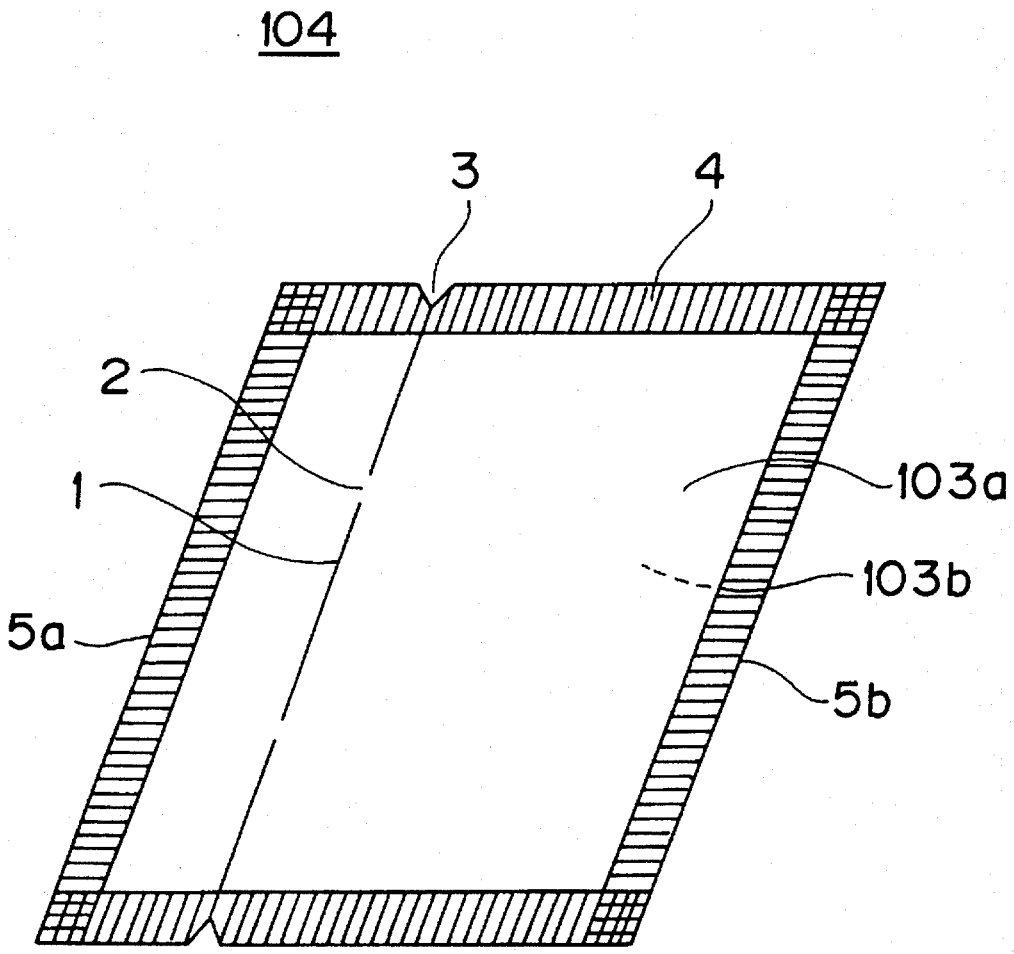
FIG. 4 is a perspective view of a pouch according to the first embodiment of the present invention.

A pouch 104, as shown in FIG. 4, is manufactured in the following manner from the compound film 103 as described above.

A pouch 104 is formed by a known heat fusing means so that two compound films 103*a* and 103*b*, in which the resin films 12 having the good heat adhesive property are respectively arranged inside and face each other and the slits 1 disposed on one side portion 5*a* of the resin films 103*a* and 103*b* are exactly coincident with each other in their positions, are thermally fused at their side edges as shown in FIG. 4. A notch 3 may be formed as occasion demands at a location continuous to one end of the slit of the compound films 103*a* (103*b*) for easily opening the pouch 104.

When the pouch 104 is opened, a force is applied to the pouch 104 by nipping both sides of the slits 1 or notch 3 and pulling the pouch 104 on one side of the slits 1 in a direction to open the same. The notch 3 is thereby cut or torn and then the slits 1 and the un-cut portions 2 of the slits 1 are also torn by further applying force in the direction to open the pouch, whereby the pouch contents such as medicine can be easily taken out without using any mechanical means such as a cutter or scissors. During this opening process, since the resin film having the large tear strength has an orientation along which the compound film including this resin film is liable to be torn and, hence, the line along which the pouch formed of such compound films is opened exactly accords with the slit extending direction, the pouch can be opened along the direction 21 along which the pouch is liable to be torn without being offset from the slits to an undesired direction.

Figure 6A:
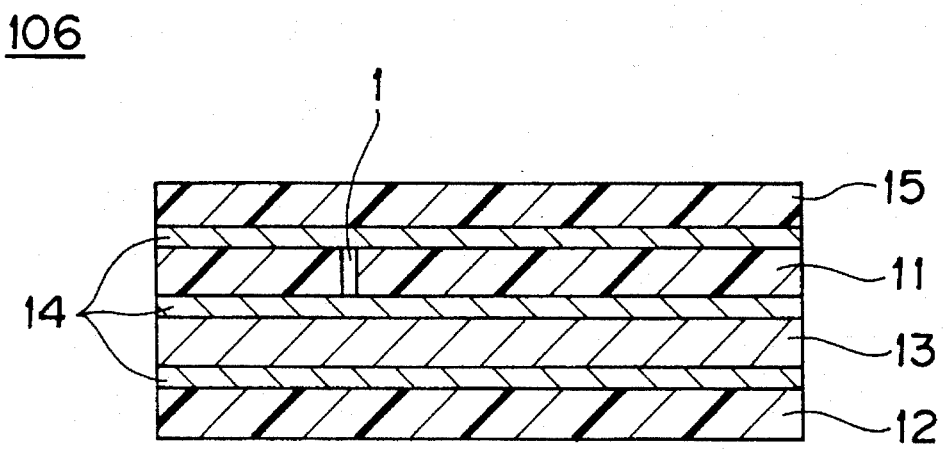
FIG. 6A is a cross sectional view of a compound film from which a pouch according to a second embodiment of the present invention is manufactured.
Figure 6B:
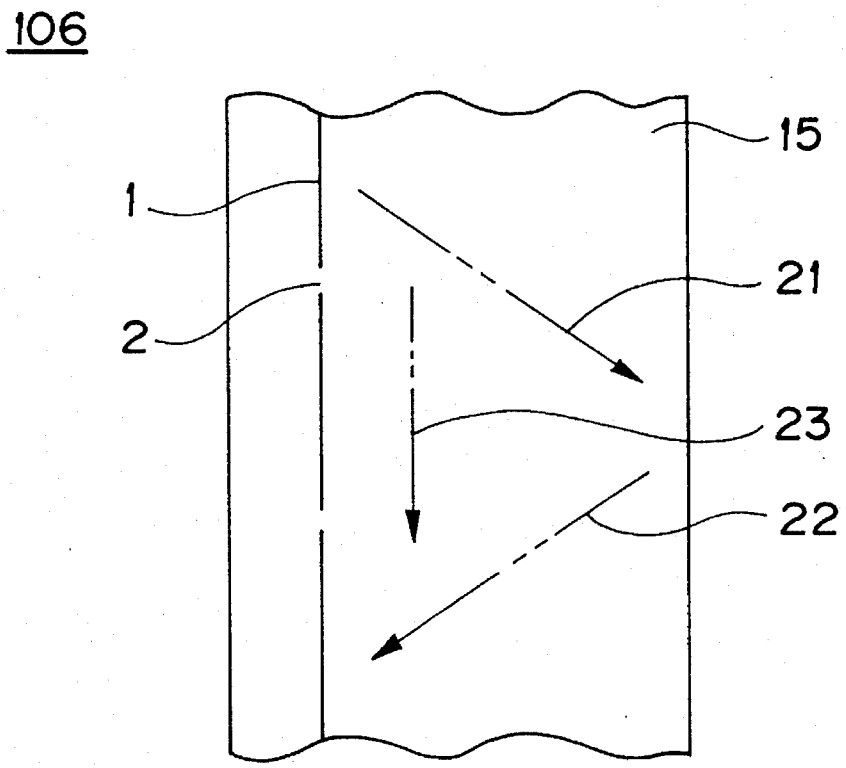
FIG. 6B is a plan view thereof, partially cut away.
Figure 7:
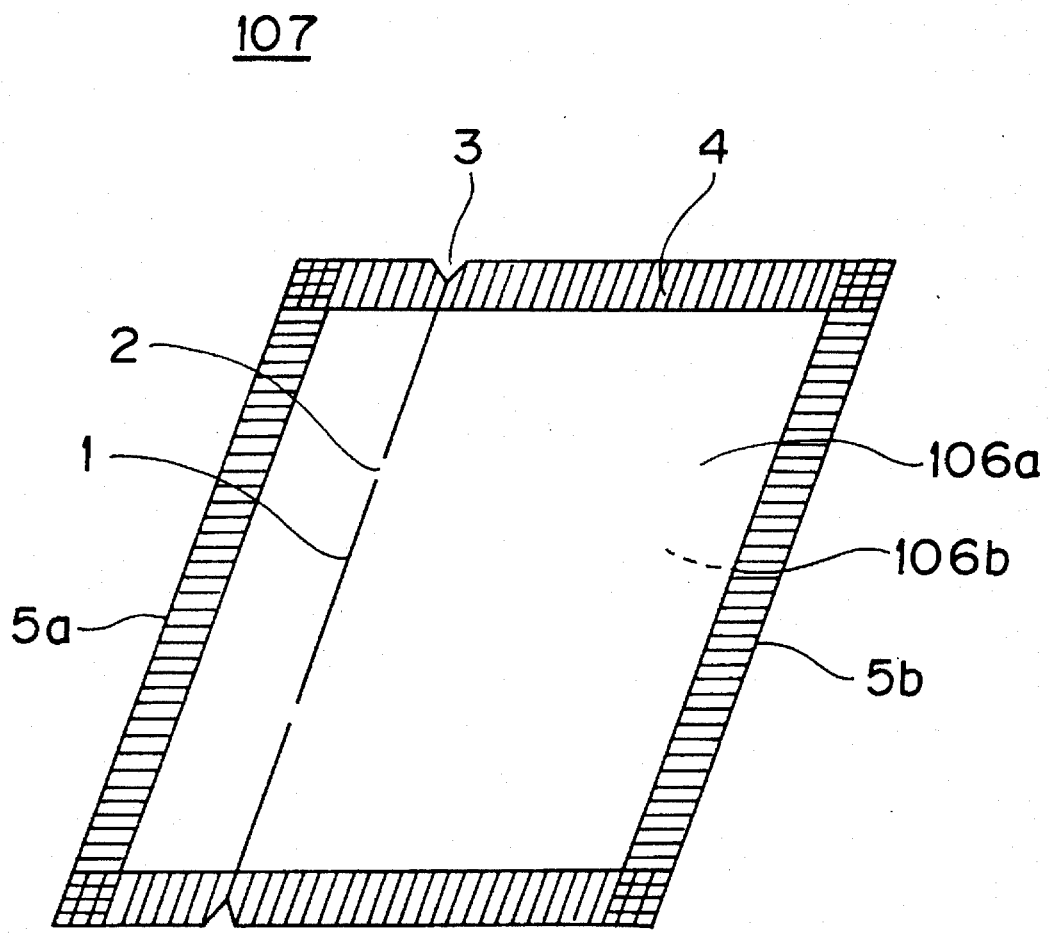
FIG. 7 is a perspective view of a pouch according to the second embodiment of the present invention.

FIGS. 6A, 6B and 7 represent the second embodiment of a pouch according to the present invention, in which a pouch 107 is formed by a compound film 106 as its material.

Referring to FIGS. 6A, 6B and 7, the compound film 106 is composed of laminated layers comprising, from the outermost layer in order when a pouch is formed by the compound film 106, a first resin film 15 having a large tear strength, a first adhesive layer 14, a second resin film 11 having a linear slit 1 and having a large tear strength, a second adhesive layer 14, an aluminium foil layer 13, a third adhesive layer 14, and a resin film 12 having a good heat adhesive property. Although the large tear strength of the first resin film 15 may be different from that of the second resin film 11, it is desired that the tear strength of the first resin film 15 is substantially the same as that of the second resin film 11. In the above embodiment, the first, second and third adhesive layers may be formed of the same substance or different substances, and the terms "first", "second" and "third" adhesive layers accord with the upper, intermediate and lower adhesive layers in FIG. 6A.

In an alternate embodiment, the first adhesive layer 14 may be eliminated, and in such case, the first resin film 15 and the second resin film 11 having the slit 1 are formed continuous, i.e. adjacent, to each other. The second resin film 11 may be disposed outside the first resin film 15.

The resin film 12 having the good heat adhesive property is always disposed to the most outer side of the compound film 106 and forms the most inner surface of the pouch when manufactured. However, it is not always necessary that the resin film 11 or 15 having the large tear strength forms the outer most surface of the pouch when manufactured and the resin film 11 or 15 form an intermediate layer between the heat adhesive resin film 12 and the other layer 13.

The compound film 106 utilized for the second embodiment of the present invention can be formed of a biaxial oriented polyethyleneterephthalate film (PET) having a thickness of 12 μm, a biaxial oriented nylon film (ON) having a thickness of 15 μm, an aluminium foil (A1) having a thickness of 9 μm and a non-oriented polypropylene film (CPP) having a thickness of 70 μm.

In the second embodiment, the films may be laminated as in the first embodiment. That is, a uniaxial or biaxial synthetic oriented resin such as biaxial polypropylene or biaxial polyethyleneterephthalate may be utilized as a material as in the first embodiment for the resin films 11 and 15 having the large tear strength. A non-oriented polyethylene film or non-oriented polypropylene film may be utilized as the resin film 12 having the good heat adhesive property. Furthermore, it will be desired to form the film 13 such as aluminium foil, which is optionally laminated, with a material having a possibly small tear strength and being liable to be torn in the same direction together with the resin film 11. In such an arrangement, it will be understood, as mentioned hereinbefore, that it is desired that the resin films 15 and 11 have substantially the same large tear strength.

Referring to FIG. 6B, the virtual arrow 21 denotes the direction along which the resin film 11 is liable to be torn and the virtual arrow 22 denotes the direction along which the resin film 15 is liable to be torn. These directions 21 and 22 are both directed obliquely with respect to the extending direction of the slit 1, and the films 11 and 15 are laminated so that these directions 21 and 22 of the respective resin films 11 and 15 are linearly balanced with respect to the extending direction of the slit 1.

This lamination process of these resin films 11 and 15 may be performed as one example in the following manner.

The resin film 11 is bent so that a bent line is formed parallel or perpendicular to the direction along which the slit 1, which has been formed or will be formed, extends, and the opposing inner surfaces of the bent portions are bonded. In this method, the resin film 15 will be the same resin film as the resin film 11 and this will be accomplished by reversing the resin film 11.

Further, it is to be noted that the directions 21 and 22 of the resin films 11 and 15 along which they are liable to be torn will be examined by the same test method as mentioned with reference to FIG. 5.

Further, in the second embodiment, the method for forming the slit 1 having the un-cut portions 2 is substantially the same as that in the first embodiment with the same width and distance of the un-cut portion. Further, in the second embodiment, the slit 1 may be formed after the lamination of the first and second resin films 15 and 11, and in such case, the slit 1 is formed also in the second resin film 11, thus improving the opening ability of the pouch when it is manufactured by the compound film formed of these resin films 11 and 15.

According to the second embodiment, two compound films 106 thus formed in the aforementioned manner are overlapped in the same manner as mentioned with reference to the first embodiment and the side edge portions are heat fused to thereby form a pouch 107 as shown in FIG. 7. The pouch 107 thus formed has substantially the same superior openability as that of the first embodiment. However, in the second embodiment, the opening direction along which the pouch 107 is opened accords with a direction (orientation) 23, which is composed of the balanced directions (orientations) 21 and 22, and which accords with the extending direction of the slit 1, and therefore, the opening line is formed along the slit extending direction, i.e. the direction along which the compound film is liable to be torn with no offset from the slit 1.

Figure 8A:
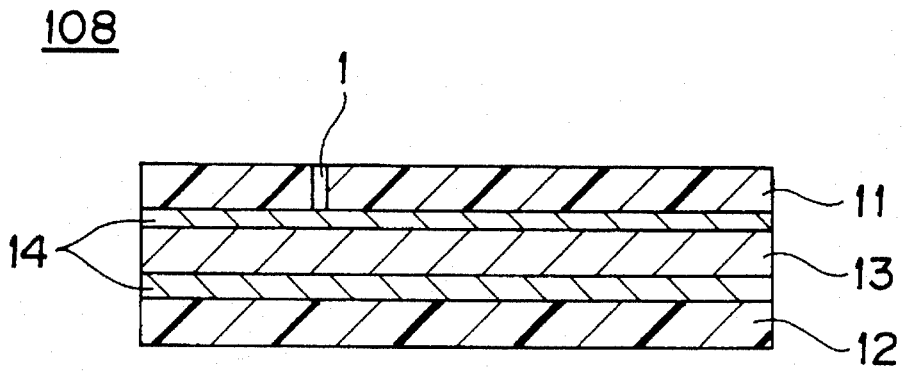
FIG. 8A is a cross sectional view of a compound film from which a pouch according to a third embodiment of the present invention is manufactured.
Figure 8B:
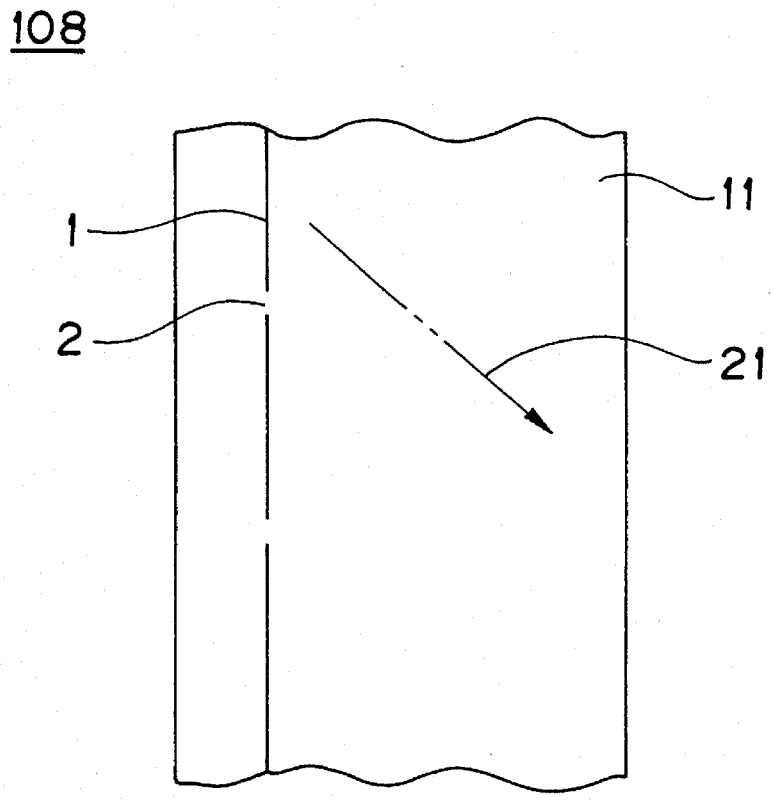
FIG. 8B is a plan view thereof, partially cut away.
Figure 9:
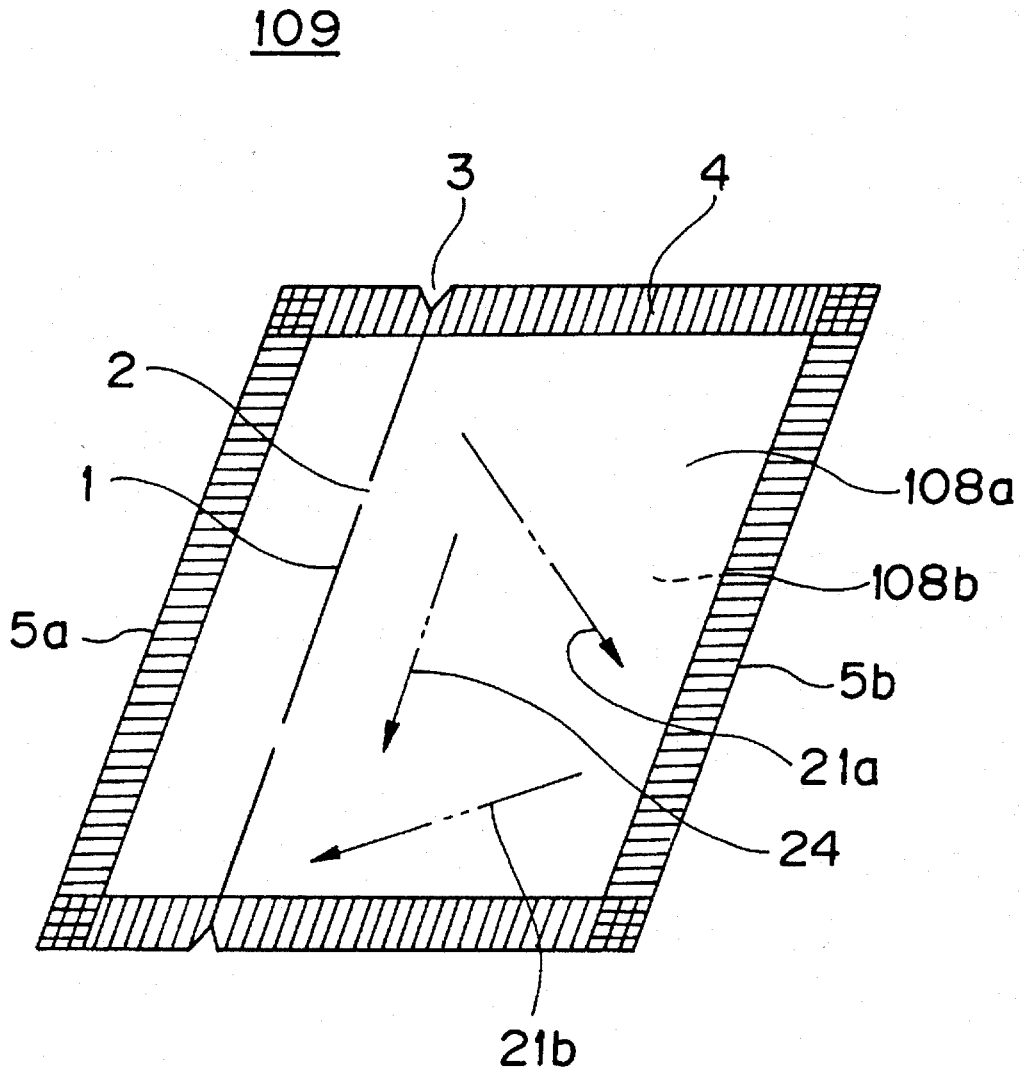
FIG. 9 is a perspective view of a pouch according to the third embodiment of the present invention.

FIGS. 8A, 8B and 9 represent the third embodiment of a pouch according to the present invention, in which a pouch 109 is formed by a compound film 108 as its material. The pouch 109 is the same type as that of the first embodiment shown in FIG. 4.

Figure 3B:
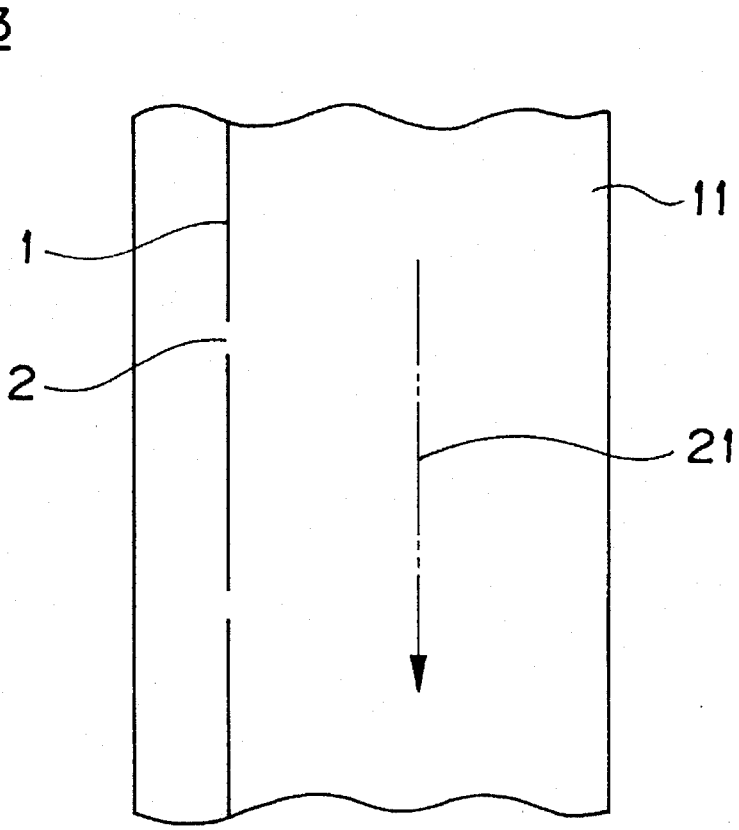
FIG. 3B is a plan view thereof, partially cut away.

Referring to FIGS. 8A, 8B and 9, the compound film 108 is substantially the same as the compound film 103 shown in FIGS. 3A and 3B except that the direction 21 of the resin film 11 along which the compound film is liable to be torn is oblique to the extending direction of the slit 1o The resin film 12 always disposed to the outer surface side of the compound film 108 and forms the most inner surface of the pouch 109 when manufactured, but it is not necessary for the resin film 11 to be exposed outside of the compound film 108 and the resin film 11 may be disposed as an intermediate layer between the resin film 12 and the other film layer 13 such as aluminium foil.

As one concrete example of the compound film 108 utilized for the third embodiment of the present invention, the compound film can be formed of a biaxial oriented polyethyleneterephthalate film (PET) having a thickness of 12 μm, an aluminium foil (A1) having a thickness of 9 μm and a non-oriented polypropylene film (CPP) having a thickness of 80 μm.

In the third embodiment, the films like in the first embodiment may be laminated. That is, a uniaxial or biaxial oriented synthetic resin such as biaxial polypropylene or biaxial polyethyleneterephthalate may be utilized as a material as in the first embodiment for the resin film 11 having the large tear strength. A non-oriented polyethylene film or non-oriented polypropylene film may be utilized as the resin film 12 having the good heat adhesive property. Furthermore, it is desired to form the other film 13 such as aluminium foil, which is optionally laminated, with a material having a possibly small tear strength and being liable to be torn in the same direction together with the resin film 11 having the large tear strength.

Referring to FIG. 8B, the virtual arrow 21 denotes the direction along which the resin film 11 is liable to be torn and the direction 21 is directed obliquely with respect to the extending direction of the slit 1. The direction 21 of the resin film 11 can be examined in the same manner as mentioned with respect to the first embodiment.

In this third embodiment, the slit 1 is formed in the resin film 11 which has an orientation 21 that is oblique to the slit extending direction and along which the compound film 11 is liable to be torn, and thereafter, the resin film 11, the resin film 12, and as occasion demands, another film such as aluminium foil 13, are laminated to thereby form the compound film 108. The pouch 109 of the third embodiment is manufactured by using the compound films 108 in a manner substantially the same as that of the first embodiment.

As shown in FIG. 9, in the third embodiment, different from the first embodiment, the outer most surfaces of the compound films 108 forming the front and back surfaces of the pouch 109 have orientations, i.e. directions **21*a* and 21*b* along which the films are liable to be torn and which have directions linearly balanced with each other with respect to the slit extending direction. The arrangement of these orientations will be obtained by disposing the compound films with the resin films 11 thereof to be opposite to each other when the compound films are laminated for forming a pouch. Accordingly, the pouch 109 can be opened along the opening line with no offset from the slit 1**, thus providing an improved pouch opening ability as in the foregoing embodiments.

According to the third embodiment, two compound films 108 having the directions **21*a* and 21*b* along which the films 108 are liable to be torn and which are linearly balanced with respect to the slit extending direction, so that when the pouch 109 is opened, the composed line, i.e. direction, 24 is generated in the direction parallel to the slit extending direction. Thus the pouch 109 is opened with no offset from the slit 1**.

As described hereinbefore with reference to the preferred embodiments, the pouch according to the present invention can be easily and exactly opened along a predetermined line along which the pouch is opened without using any mechanical means such as knife or scissor.

It is to be noted that the present invention is not limited to the described preferred embodiments and many other changes or modifications may be made without departing from the scope of the appended claims.

What is claimed is:

1. A pouch comprising:

a first compound film forming a front surface of the pouch and comprising (i) a first resin film having a predetermined tear strength and a linear slit having un-cut portions provided therein, (ii) a second resin film having a good heat adhesive property laminated on one surface of said first resin film, and (iii) a third resin film having a predetermined tear strength laminated adjacent to said first resin film;

said first resin film of said first compound film having an orientation along which it has a tendency to tear, the orientation extending in a direction inclined with respect to the direction of said linear slit by a positive angle X, said third resin film of said first compound film having an orientation along which it has a tendency to tear, the orientation extending in a direction inclined with respect to the direction of said linear slit by a negative angle Y, wherein angles X and Y are substantially equal in magnitude;

a second compound film forming a back surface of the pouch and comprising (i) a first resin film having a predetermined tear strength and a linear slit having un-cut portions provided therein, (ii) a second resin film having a good heat adhesive property laminated on one surface of said first resin film, and (iii) a third resin film having a predetermined tear strength laminated adjacent to said first resin film;

said first resin film of said second compound film having an orientation along which it has a tendency to tear, the orientation extending in a direction inclined with respect to the direction of said linear slit by a positive angle X, said third resin film of said second compound film having an orientation along which it has a tendency to tear, the orientation extending in a direction inclined with respect to the direction of said linear slit by a negative angle Y, wherein angles X and Y are substantially equal in magnitude;

wherein said first and second compound films are overlapped with each ocher and peripheral portions thereof are heat fused such that (a) the second resin films are disposed inside the pouch, (b) the linear slits formed in the first resin films are positioned coincident with each other, and (c) the orientations of the first and third resin films of the first compound film are substantially aligned with the orientations of the first and third resin films of the second compound film, respectively.

2. A pouch according to claim 1, wherein said first and third resin films have substantially the same tear strength.

3. A pouch according to claim 1, wherein each of said first and second compound films further comprises an aluminium foil layer disposed outside the second resin film of each compound film when the first and second compound films are laminated to form a pouch.

4. A pouch according to claim 1, wherein said first resin film comprises a biaxial oriented polyethylene-terephthalate film, said third resin film comprises a biaxial oriented nylon film, and said second film comprises a non-oriented polypropylene film.

5. A pouch according to claim 1, wherein a notch is formed in the periphery of each of the first and second compound films at a portion continuous to one end portion of said linear slit.

6. A pouch according to claim 1, further comprising adhesive layers formed between the first and second resin films and between the first and third resin films of each compound film.

7. A pouch comprising:

a first compound film forming a front surface of the pouch and comprising (i) a first resin film having a predetermined tear strength and a linear slit having un-cut portions provided therein, and (ii) a second resin film having a good heat adhesive property laminated on one surface of said first resin film;

said first resin film of said first compound film having an orientation along which it has a tendency to tear, the orientation extending in a direction inclined with respect to the direction of said linear slit by a positive angle X;

a second compound film forming a back surface of the pouch and comprising (i) a first resin film having a predetermined tear strength and e linear slit having un-cut portions provided therein, and (ii) a second resin film having a good heat adhesive property laminated on one surface of said first resin film;

said first resin film of said second compound film having an orientation along which it has a tendency to tear, the orientation extending in a direction inclined with respect to the direction of said linear slit by a negative angle Y;

wherein said first and second compound films are overlapped with each other and peripheral portions thereof are heat fused such that (a) the second resin films are disposed inside the pouch, (b) the linear slits formed in the first resin films are positioned coincident with each other, and (c) the orientations of the first resin films are positioned relative to each other such that angles X and Y are substantially equal in magnitude.

8. A pouch according to claim 7, wherein each of said first and second compound films further comprises an aluminium foil layer disposed outside the second resin film of each compound film when the first and second compound films are laminated to form a pouch.

9. A pouch according to claim 7, wherein said first resin film comprises a biaxial oriented polyethylene-terephthalate film and said second film comprises a non-oriented polypropylene film.

10. A pouch according to claim 7, wherein a notch is formed in the periphery of each of the first and second compound films at a portion continuous to one end portion of said linear slit.

11. A pouch according to claim 7, further comprising an adhesive layer formed between the first and second resin films of each compound film.

* * * * *